US010279950B2

(12) United States Patent
Chang

(10) Patent No.: US 10,279,950 B2
(45) Date of Patent: May 7, 2019

(54) ANTI-THEFT PACKAGING CASE HAVING DOUBLE BOTTOMS AND DOUBLE COVERS

(71) Applicant: BEIJING YISIDE LOGISTICS TECHNOLOGY CO., LTD., Beijing (CN)

(72) Inventor: Jiang Chang, Beijing (CN)

(73) Assignee: BEIJING YISIDE LOGISTICS TECHNOLOGY CO., LTD., Beijing (CN)

( * ) Notice: Subject to any disclaimer, the term of this patent is extended or adjusted under 35 U.S.C. 154(b) by 67 days.

(21) Appl. No.: 15/552,876

(22) PCT Filed: Dec. 29, 2015

(86) PCT No.: PCT/CN2015/099411
§ 371 (c)(1),
(2) Date: Aug. 23, 2017

(87) PCT Pub. No.: WO2016/138789
PCT Pub. Date: Sep. 9, 2016

(65) Prior Publication Data

US 2018/0044051 A1 Feb. 15, 2018

(30) Foreign Application Priority Data

Mar. 3, 2015 (CN) ..... 2015 2 0124361

(51) Int. Cl.
*B65D 5/50* (2006.01)
*B65D 5/06* (2006.01)
(Continued)

(52) U.S. Cl.
CPC ..... *B65D 5/062* (2013.01); *B65D 5/0227* (2013.01); *B65D 5/50* (2013.01); *B65D 5/5405* (2013.01);
(Continued)

(58) Field of Classification Search
CPC ..... B65D 5/062; B65D 5/0227; B65D 5/50; B65D 5/5405; B65D 5/70; B65D 2101/0023
See application file for complete search history.

(56) References Cited

U.S. PATENT DOCUMENTS 2,260,137 A * 10/1941 Donnelly ..... B65D 5/5425 229/132
2,670,128 A * 2/1954 Stowitts ..... B65D 5/0227 229/132
(Continued)

FOREIGN PATENT DOCUMENTS

CN 201343198 Y 11/2009
CN 201512138 U 6/2010
(Continued)

OTHER PUBLICATIONS

International Search Report and Written Opinion dated Feb. 6, 2016 from International Patent Application No. PCT/CN2015/099411 (with English translation of International Search Report).

*Primary Examiner* — Corey N Skurdal
(74) *Attorney, Agent, or Firm* — Dickinson Wright PLLC

(57) ABSTRACT

An anti-theft packaging case having double bottoms and double covers includes a top cover portion, side plates, and a bottom plate portion. The top cover portion includes an upper cover, a lower cover, a left cover, and a right cover. The bottom plate portion includes a left bottom plate, a right bottom plate, an inner bottom plate, and an outer bottom plate. The upper cover is provided with a tear strip and an anti-theft line. The tear strip is provided with a strengthening rib. The anti-theft packaging case having double bottoms and double covers greatly reduces risks that the sealing of the packaging case is broken and the packaging case is cracked or stolen, and has very good anti-theft performance.

10 Claims, 1 Drawing Sheet

(51) Int. Cl.
*B65D 5/70* (2006.01)
*B65D 5/02* (2006.01)
*B65D 5/54* (2006.01)

(52) U.S. Cl.
CPC ..... *B65D 5/70* (2013.01); *B65D 2101/0023* (2013.01)

(56) References Cited

U.S. PATENT DOCUMENTS 2,996,235 A * 8/1961 Turpin ..... B65D 5/0227 229/125.34
4,088,263 A * 5/1978 Michetti ..... B65D 5/0227 229/132
4,159,076 A * 6/1979 Engdahl, Jr. ..... B65D 5/0227 229/132
4,508,226 A * 4/1985 Davis ..... B65D 5/0227 206/807
4,746,052 A * 5/1988 Schmissrauter ..... B65D 5/42 206/807
5,190,155 A * 3/1993 Grunwald ..... B65D 5/5405 206/459.1
5,265,794 A * 11/1993 Johnston ..... B65D 5/0227 206/459.5
5,582,344 A * 12/1996 Lawson ..... B65D 5/563 229/132
9,567,130 B1 * 2/2017 Drouet ..... B65D 5/52
2004/0069844 A1 * 4/2004 Bingle ..... B65D 5/0227 229/242
2011/0111938 A1 * 5/2011 Smith ..... B65D 5/0227 493/162
2012/0153014 A1 6/2012 Won et al.
2015/0321788 A1 * 11/2015 Hengami ..... B65D 5/723 229/122
2015/0344172 A1 * 12/2015 Baker ..... B65D 5/0227 229/208

FOREIGN PATENT DOCUMENTS

CN 102556464 A 7/2012
CN 204606426 U 9/2015
CN 204701879 U 10/2015
EP 0115813 A2 8/1984
KR 20120086482 A 8/2012

* cited by examiner

ANTI-THEFT PACKAGING CASE HAVING DOUBLE BOTTOMS AND DOUBLE COVERS

This application is a National Phase entry of PCT Application No. PCT/CN2015/099411, filed Dec. 29, 2015, which claims the priority to Chinese Patent Application No. 201520124361.7 titled "ANTI-THEFT PACKAGING CASE HAVING DOUBLE BOTTOMS AND DOUBLE COVERS", filed with the Chinese State Intellectual Property Office on Mar. 3, 2015, the entire disclosures of which are incorporated herein by reference.

FIELD

The present application relates to the technical field of packaging, and more particularly to a packaging case having double bottoms and double covers.

BACKGROUND

With the rapid development of the express industry, a large number of packaging cases are used. A serious problem presented is that the packaging cases have poor packaging strength and security. A top plate and a bottom plate of one packaging case each have only one layer of case plate structure, especially, almost all of the conventional packaging cases have one layer of folded bottom cover structure, thus, the packaging case is easy to crack in the carrying, and the goods within the packaging case can be easily stolen through the bottom plate. That is to say, the structures of the bottom plate of the conventional packaging case have no anti-theft measures. Moreover, the overall structure of the packaging case causes poor performance in withstanding compression, damage and the like. Furthermore, the conventional packaging case is sealed by tapes, and in the express delivery process, someone can peel off the tapes on a packaging case, steal the goods in the packaging case, and then seal the packaging case with tapes as before, which can hardly be identified by the recipient, causing extremely poor security. Moreover, it needs scissors and other tools to open the packaging case, which is extremely inconvenient, and the use of tapes causes a large waste of packaging materials.

SUMMARY

Based on the above-mentioned technical issues, a packaging case having a totally new structure is provided according to the present application. The innovative design of the packaging case having double bottoms and double covers ensures the compressive strength and breakability of the packaging case, greatly reducing risks that the packaging case is unsealed, cracked or stolen in the transporting process. Moreover, a double-sided adhesive tape or a hot-melt adhesive having a high peel strength are used for sealing the case at the bottom and top of the case, thus, it is almost impossible to unseal or open the packaging case from the bottom and the top of the case where the case is sealed. Furthermore, anti-theft lines are designed at the bottom and the top of the packaging case where the case is sealed. Once to unseal or to break the bottom and the top where the case is sealed, the anti-theft lines may just be destroyed, which can remind the recipient that the packaging case is damaged and then the goods can be rejected, that is, remind the recipient of raising the vigilance, and greatly improve the security of the packaging case. The design of high-strength tear line structure in the packaging case makes it possible to open the packaging case quickly and easily, and the recycling rate and working efficiency of the packaging case are greatly improved.

The technical solutions adopted by the present application for addressing the above technical issues are as follows:

an anti-theft packaging case having double bottoms and double covers, including a top cover portion, side plates, and a bottom plate portion, wherein the top cover portion includes an upper cover, a lower cover, a left cover and a right cover, and the bottom plate portion includes a left bottom plate, a right bottom plate, an inner bottom plate and an outer bottom plate, and the upper cover is provided with a tear strip and an anti-theft line, and the tear strip is provided with a strengthening rib.

Further, the tear strip is formed by providing several stub cut holes, curved holes or circular holes extending through the upper cover and apart from each other along two parallel lines at a middle portion of the upper cover.

Further, the strengthening rib is one or multiple strands or plastic strips arranged in the vicinity of the center of an inner side of the tear strip in an extending direction of the tear strip.

Further, the anti-theft line is formed by two groups of symmetrically arranged cutter lines.

Further, the left cover and the right cover are configured to close the packaging case, and in the packaging, the lower cover is folded over the left cover and the right cover, and then the upper cover is folded over the lower cover, so as to form a double cover structure.

Further, an outer surface of the bottom of the lower cover is provided with an adhesive bonding area, and in the packaging, an inner surface of the upper cover is adhered to the adhesive bonding area.

Further, front ends of the left cover, the right cover and the lower cover are each provided with a notch, and the notch has a semicircular shape, a square shape or a trapezoidal shape.

Further, the left bottom plate and the right bottom plate are configured to close the packaging case, and in the packaging, the inner bottom plate is folded over the left bottom plate and the right bottom plate, and the outer bottom plate is folded over the inner bottom plate, so as to form a double bottom structure.

Further, an outer surface of the inner bottom plate is provided with an adhesive bonding area, and in the packaging, the inner surface of the outer bottom plate is adhered to the adhesive bonding area.

At least the following technical effects can be achieved by the technical solution of the present application:

1. The anti-theft packaging case having double bottoms and double covers greatly reduces risks that the packaging case is unsealed, cracked or stolen, which has superior anti-theft performance.

2. The use of the double-sided adhesive tape or hot-melt adhesives with a high original adhesion, a strong static shear adhesion and a high peel strength to seal the package makes it hardly to remove the double-sided adhesive tape or hot-melt adhesives from the place where the case is sealed, and a lot of tape is also dispensed, and the efficiency in sealing the case is improved.

3. The design of anti-theft line has two groups of symmetrically arranged cutter lines at the bottom and the top of the case where the case is sealed, and once to unseal or to break at the place where the case is sealed, the anti-theft line may just be damaged, which can remind the recipient that goods within the packaging case might have been stolen, and raise the recipient's vigilance.

4. The packaging case can be opened based on the tear line, and thus the efficiency of opening the packaging case is improved and the potential risks are reduced.

The packaging case according to the present application has superior anti-theft performance and saves a lot of tape, and has an improved overall compressive strength. The packaging case is easy to use and can be recycled, and has a promising market.

BRIEF DESCRIPTION OF THE DRAWINGS

For more clearly illustrating embodiments of the present application or technical solutions in the conventional technology, drawings used in the description of the embodiments or the conventional technology will be briefly described hereinafter. Apparently, the drawings in the following description are merely some embodiments of the present application, and for the person skilled in the art, other drawings may be obtained based on these drawings, without making any creative efforts.

Figure 1:
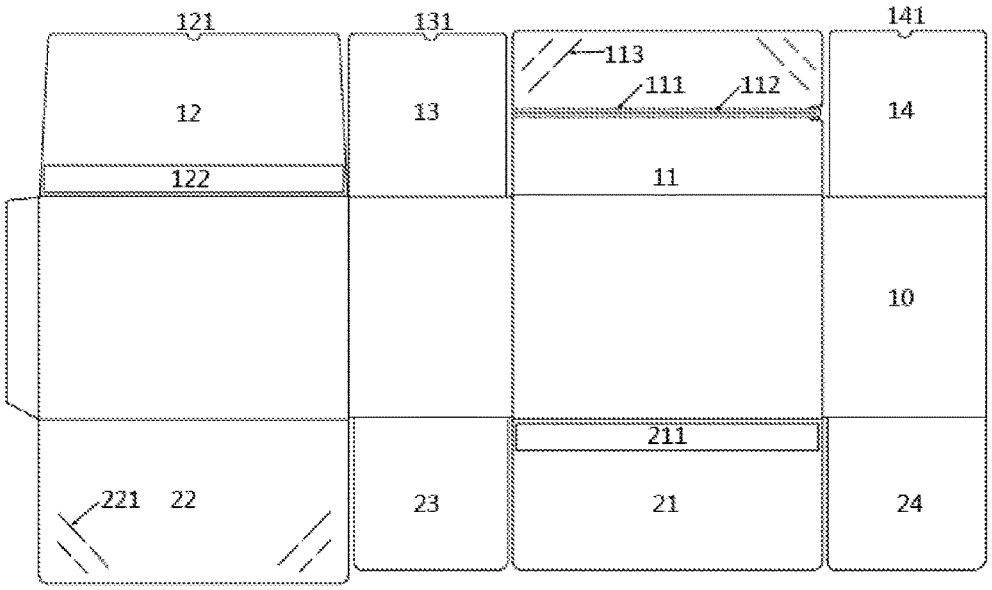
FIG. 1 is a schematic view showing an expanded structure of a packaging case according to the present application.
Figure 2:
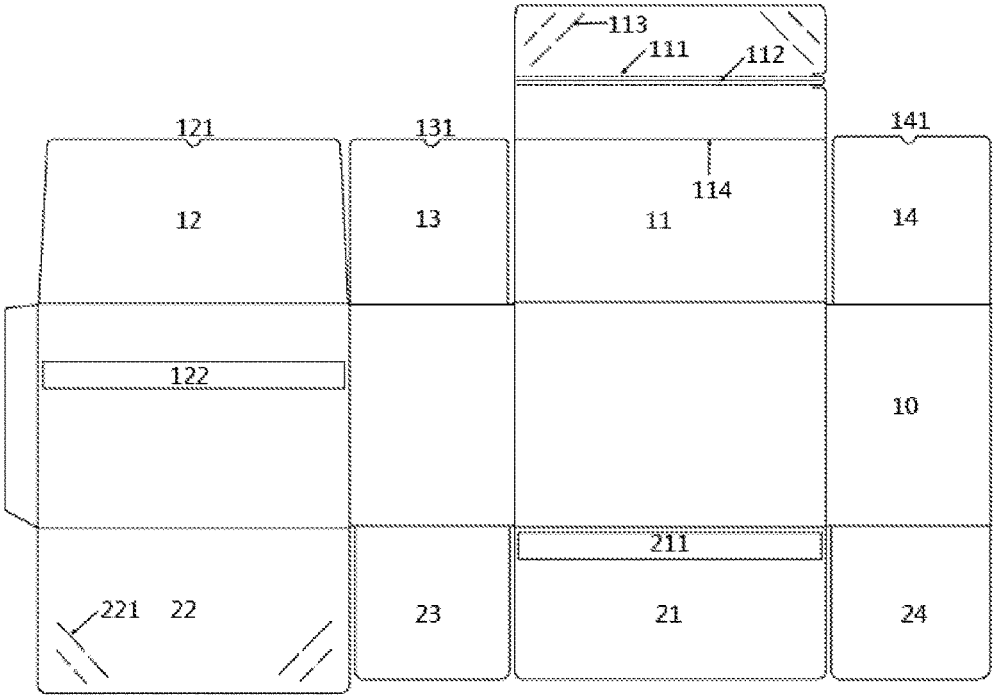
FIG. 2 is a schematic view showing the structure of the packaging case according to the present application with a width less than or equal to 5 cm.

The denotations of the reference numerals in FIGS. 1 to 2 are as follows:

| | | |
|---|---|---|
| 10 side plate, | 11 top cover, | 12 lower cover, |
| 13 left cover, | 14 right cover, | 111 tear strip, |
| 112 strengthening rib, | 113 anti-theft line, | 122 adhesive bonding area, |
| 121 notch, | 131 notch, | 141 notch, |
| 21 inner bottom plate, | 211 adhesive bonding area, | 22 outer bottom plate, |
| 221 anti-theft line, | 23 left bottom plate, | 24 right bottom plate. |

DETAILED DESCRIPTION

The technical solutions of the present application will be described in detail with reference to the drawings, so as to enable the person skilled in the art to better understand the solution of the present application but not to limit the scope of the present application accordingly.

As shown in FIG. 1, an anti-theft packaging case having double bottoms and double covers includes a top cover portion, side plates 10, and a bottom plate portion. The top cover portion includes an upper cover 11, a lower cover 12, a left cover 13, and a right cover 14. The bottom plate portion includes a left bottom plate 23, a right bottom plate 24, an inner bottom plate 21, and an outer bottom plate 22. The upper cover 11 is provided with a tear strip 111 and an antitheft line 113. The tear strip 111 is provided with a strengthening rib 112. The tear strip 111 is formed by providing several stub cut holes, curved holes or circular holes extending through the upper cover and apart from each other along two parallel lines at a middle portion of the upper cover 11. The strengthening rib 112 is one or more strands or plastic strips arranged in the vicinity of the center of an inner side of the tear strip 111 in an extending direction of the tear strip 111. The anti-theft line 113 is formed by two groups of symmetrically arranged cutter lines, thus achieving the anti-theft and anti-loss, and reminding customers to identify whether the packaging was opened before, saving a lot of tape, and improving the efficiency in opening the packaging case and saving time.

Furthermore, the packaging case is a closed case with double covers. The left cover 13 and the right cover 14 are configured to close the packaging case, and in the packaging, the lower cover 12 is folded over the left cover 13 and the right cover 14, and then the upper cover 11 is folded over the lower cover 12. An outer surface of the bottom of the lower cover 12 is provided with an adhesive bonding area 122, and in the packaging, an inner surface of the upper cover 11 is adhered to the adhesive bonding area 122. Front ends of the left cover 13, the right cover 14 and the lower cover 12 are provided with notches 131, 141 and 121 respectively, and each of the notches 131, 141 and 121 may have a semicircular shape, a square shape or a trapezoidal shape. The packaging case is a closed case with double bottoms, the left bottom plate 23 and the right bottom plate 24 are configured to close the packaging case, and in the packaging, the inner bottom plate 21 is folded over the left bottom plate 23 and the right bottom plate 24, and then the outer bottom plate 22 is folded over the inner bottom plate 21. An outer surface of the inner bottom plate 21 is provided with an adhesive bonding area 211, and in the packaging, an inner surface of the outer bottom plate 22 is adhered to the adhesive bonding area 211. Each of the corners has a rounded structure, in this way, the structure with double bottoms and double covers greatly reduces risks that the packaging case is unsealed, is cracked or stolen, and has superior anti-theft performance, and the use of a double-sided adhesive tape or hot-melt adhesives with a high original adhesion, a strong static shear adhesion and a high peel strength to seal the package makes it hardly to remove the double-sided adhesive tape or hot-melt adhesives from the place where the case is sealed.

FIG. 2 shows a solution suitable for a packaging case that is relatively narrow, for example, in the case that the packaging case has a width less than or equal to 5 cm, it is recommended to use the solution shown in FIG. 2. The structure of FIG. 2 is also applicable to a big packaging case. Compared with the solution in FIG. 1, the bottom plate and the side plates in the solution in FIG. 2 are unchanged, and the adhesive bonding area of the lower cover 12 of the top plate is moved downwards, and the upper cover 11 is lengthened, and a line 114 is a creasing line. When the side plates 10 are connected to form a case shape, the upper cover 11 is bent inwards by the creasing line 114, such that the inner surface of the upper cover 11 is adhered to the adhesive bonding area 122, thus finishing the sealing of the top cover.

Only preferred embodiments of the present application are described hereinbefore, and the technical solutions of the present application are not limited thereto. Any known modifications made by the person skilled in the art on the basis of the main technical concept of the present application are within the technical areas claimed by the present application, the specific scope of the present application is indicated by the disclosure of the claims.

What is claimed is:

1. An anti-theft packaging case having double bottoms and double covers, comprising:

a top cover portion, side plates, and a bottom plate portion, wherein the top cover portion comprises an upper cover, a lower cover, a left cover and a right cover, the bottom plate portion comprises a left bottom plate, a right bottom plate, an inner bottom plate and an outer bottom plate, the upper cover is provided with a tear strip and an anti-theft line, and the tear strip is provided with a strengthening rib.

2. The anti-theft packaging case having double bottoms and double covers according to claim 1, wherein the tear strip is formed by providing a plurality of stub cut holes, curved holes or circular holes extending through the upper cover and apart from each other along two parallel lines at a middle portion of the upper cover.

3. The anti-theft packaging case having double bottoms and double covers according to claim 1, wherein the strengthening rib is one or a plurality of strands or plastic strips arranged in the vicinity of the center of an inner side of the tear strip in an extending direction of the tear strip.

4. The anti-theft packaging case having double bottoms and double covers according to claim 1, wherein the anti-theft line is formed by two groups of symmetrically arranged cutter lines.

5. The anti-theft packaging case having double bottoms and double covers according to claim 1, wherein the left cover and the right cover are configured to close the packaging case, and in the packaging, the lower cover is folded over the left cover and the right cover, and then the upper cover is folded over the lower cover to form a double cover structure.

6. The anti-theft packaging case having double bottoms and double covers according to claim 5, wherein front ends of the left cover, the right cover and the lower cover are each provided with a notch, and the notch has a semicircular shape, a square shape or a trapezoidal shape.

7. The anti-theft packaging case having double bottoms and double covers according to claim 1, wherein the outer surface of the bottom of the lower cover is provided with an adhesive bonding area, and in the packaging, an inner surface of the upper cover is adhered to the adhesive bonding area.

8. The anti-theft packaging case having double bottoms and double covers according to claim 1, wherein front ends of the left cover, the right cover and the lower cover are each provided with a notch, and the notch has a semicircular shape, a square shape or a trapezoidal shape.

9. The anti-theft packaging case having double bottoms and double covers according to claim 1, wherein the left bottom plate and the right bottom plate are configured to close the packaging case, and in the packaging, the inner bottom plate is folded over the left bottom plate and the right bottom plate, and the outer bottom plate is folded over the inner bottom plate to form a double bottom structure.

10. The anti-theft packaging case having double bottoms and double covers according to claim 1, wherein an outer surface of the inner bottom plate is provided with an adhesive bonding area, and in the packaging, the inner surface of the outer bottom plate is adhered to the adhesive bonding area.

* * * * *